US006599086B2

(12) United States Patent
Soja

(10) Patent No.: US 6,599,086 B2
(45) Date of Patent: Jul. 29, 2003

(54) ADJUSTABLE PUMP WEAR PLATE POSITIONING ASSEMBLY

(75) Inventor: Marc S. C. Soja, 98 Baby Point Road, Toronto, Ontario (CA), M6S 2G3

(73) Assignee: Marc S. C. Soja, Toronto (CA)

( * ) Notice: Subject to any disclaimer, the term of this patent is extended or adjusted under 35 U.S.C. 154(b) by 19 days.

(21) Appl. No.: 09/897,082

(22) Filed: Jul. 3, 2001

(65) Prior Publication Data

US 2003/0012642 A1 Jan. 16, 2003

(51) Int. Cl.[7] ..... F04D 29/42
(52) U.S. Cl. ..... 415/128; 415/174.1; 415/196
(58) Field of Search ..... 415/128, 170.1, 415/172.1, 173.1, 173.2, 174.1, 196

(56) References Cited

U.S. PATENT DOCUMENTS 3,754,834 A * 8/1973 Wolters ..... 415/172.1 X
4,057,361 A * 11/1977 Renaud ..... 403/378
4,527,948 A * 7/1985 Addie ..... 415/128
4,913,619 A * 4/1990 Haentjens et al. ..... 415/172.1
5,971,704 A * 10/1999 Blattmann ..... 415/174.1 X

FOREIGN PATENT DOCUMENTS

EP 292113 A2 * 11/1988 ..... F04D/29/16

* cited by examiner

*Primary Examiner*—Edward K. Look
*Assistant Examiner*—Richard A. Edgar

(57) ABSTRACT

An adjustable wear plate positioning assembly for a centrifugal pump having a casing with an inlet port offset from a pump impeller mounted within an impeller housing. The positioning assembly includes a wear plate carrier extending between a front wall of the housing and the impeller chamber. The wear plate carrier has an outer end slidably received an aperture through the front wall. The wear plate carrier further has an inner end slidably received within a second aperture in the partition wall opposite an inlet face of the impeller. A mounting plate is secured to the outer end of the wear plate carrier and disposed externally of the casing. Adjustable limit means and releasable locking means act between the front wall and the flange for positioning the carrier and in turn the wear plate relative to the impeller and for locking the assembly in place.

7 Claims, 3 Drawing Sheets

ADJUSTABLE PUMP WEAR PLATE POSITIONING ASSEMBLY

FIELD OF THE INVENTION

This invention relates generally to centrufigal pumps. More particularly, this invention relates to wear plate assemblies associated with such pumps. Still more particularly, this invention relates to apparatus for adjusting the position of such plate assemblies.

BACKGROUND OF THE INVENTION

A typical centrufigal pump has an inlet chamber separated from an outlet chamber with an impeller chamber disposed therebetween. The impeller chamber houses an impeller having a series of vanes radially disposed about an impeller axis co-incidental with an impeller shaft. The impeller shaft is generally driven by a motor which causes it to spin. The impeller has a front face fluidly communicating with the inlet chamber through an aperture generally axially aligned with the impeller. The outlet chamber is disposed about the impeller chamber and fluidly communicates with the impeller chamber through fluid passages generally radially disposed about the impeller.

As fluid passes from the inlet chamber into the impeller housing, the spinning impeller displaces the fluid radially through centrufigal force imparted by the impeller causing the fluid to flow into the outlet chamber. An inlet port is provided into the inlet chamber for admitting fluid into the pump. An outlet or discharge opening is provided from the outlet chamber to discharge fluid from the pump. The inlet chamber, impeller chamber and outlet chamber are contained within a pump casing.

Maximum pumping efficiency requires relatively precise tolerances to be maintained between the impeller and the impeller chamber. With use, wear will incur which causes clearance to increase between the impeller and the impeller housing reducing the efficiency of the pump. In order to accommodate wear without having to replace the pump casing, a replaceable wear plate is provided between the impeller chamber and the impeller. Although the wear plate could be replaced once the pump wears, some designs provide for relative movement between the wear plate and the pump impeller to take up clearance without replacing any of the components.

One manner for taking up clearance is to provide shims between the wear plate and the pump casing which correspond in thickness to the amount of wear. Although this eliminates the need for replacing the casing or the wear plate, it nevertheless requires disassembly of the pump to insert the shims which is both time consuming and costly in down time period.

Various mechanism have been proposed for movably mounting the wear plate to enable adjustment without shimming. Some of these nevertheless require at least partial disassembly of the pump in order to make the adjustment. Others are rather complicated and costly, often being unserviceable through corrosion related seizure by the time adjustment is required.

It is an object of the present invention to provide an adjustable wear plate assembly for a pump which is accessible externally of the pump without pump disassembly. A further object of the present invention is to provide such a positioning assembly which is simple, relatively inexpensive and not prone to corrosion related seizures.

SUMMARY OF THE INVENTION

An adjustable wear plate positioning assembly is provided for a pump having a casing housing and an impeller and defining a circumferential and rear face of an impeller chamber disposed about the impeller. The pump further has a discharge chamber fluidly communicating with the impeller chamber and a discharge outlet for discharging fluid from the casing. An inlet chamber fluidly communicates with the impeller chamber, has an inlet port through the casing and provides a fluid passage to an inlet face of the impeller. The impeller chamber is further defined by a wear plate adjacent an inlet face of the impeller and has a fluid passage therethrough for admitting fluid axially into the fluid chamber. The casing has a front wall opposite the inlet face of the impeller and a partition wall dividing an inlet chamber from the outlet chamber. The adjustable wear plate positioning assembly has a wear plate carrier extending between the front wall and the partition wall. The wear plate carrier has an outer end slidingly received in a first aperture through the front wall remote from the inlet port and opposite the inlet face of the impeller. The wear plate carrier further has an inner end opposite the outer end slidably engaging a second aperture through the partition wall adjacent the inlet face of the impeller. The wear plate is rigidly securable to the inner end of the wear plate carrier and the inner end has a passage therethrough registering with the fluid passage through the wear plate. A mounting plate is disposed externally of the casing adjacent the front wall of the casing and secured to the outer end of the wear plate carrier. Adjustable limit means extend between the mounting plate and the front wall to limit movement of the flange and in turn the wear plate toward the impeller. Releasable locking means act between the front wall and the flange for securing the mounting plate in position relative to the front wall.

The adjustable limit means may include a plurality of set screws extending through the mounting plate and abutting against the front wall.

The releasable locking means may include a plurality of threaded fasteners extending between the front wall and the mounting plate.

The wear plate carrier may have a plurality of spaced apart struts extending between the inner and outer ends. The inner and outer ends may be generally annular and respective fluid sealing members may extend between the inner and outer ends and the first and second apertures.

The outer end of the wear plate may have a passage extending axially therethrough and a removable cover over the aperture to provide access to the impeller. The flange may be removably securable to the outer end and act as the cover.

DESCRIPTION OF DRAWINGS

Preferred embodiments of the present invention are described below with reference to the accompanying figures in which.

DESCRIPTION OF PREFERRED EMBODIMENTS

Figure 1:
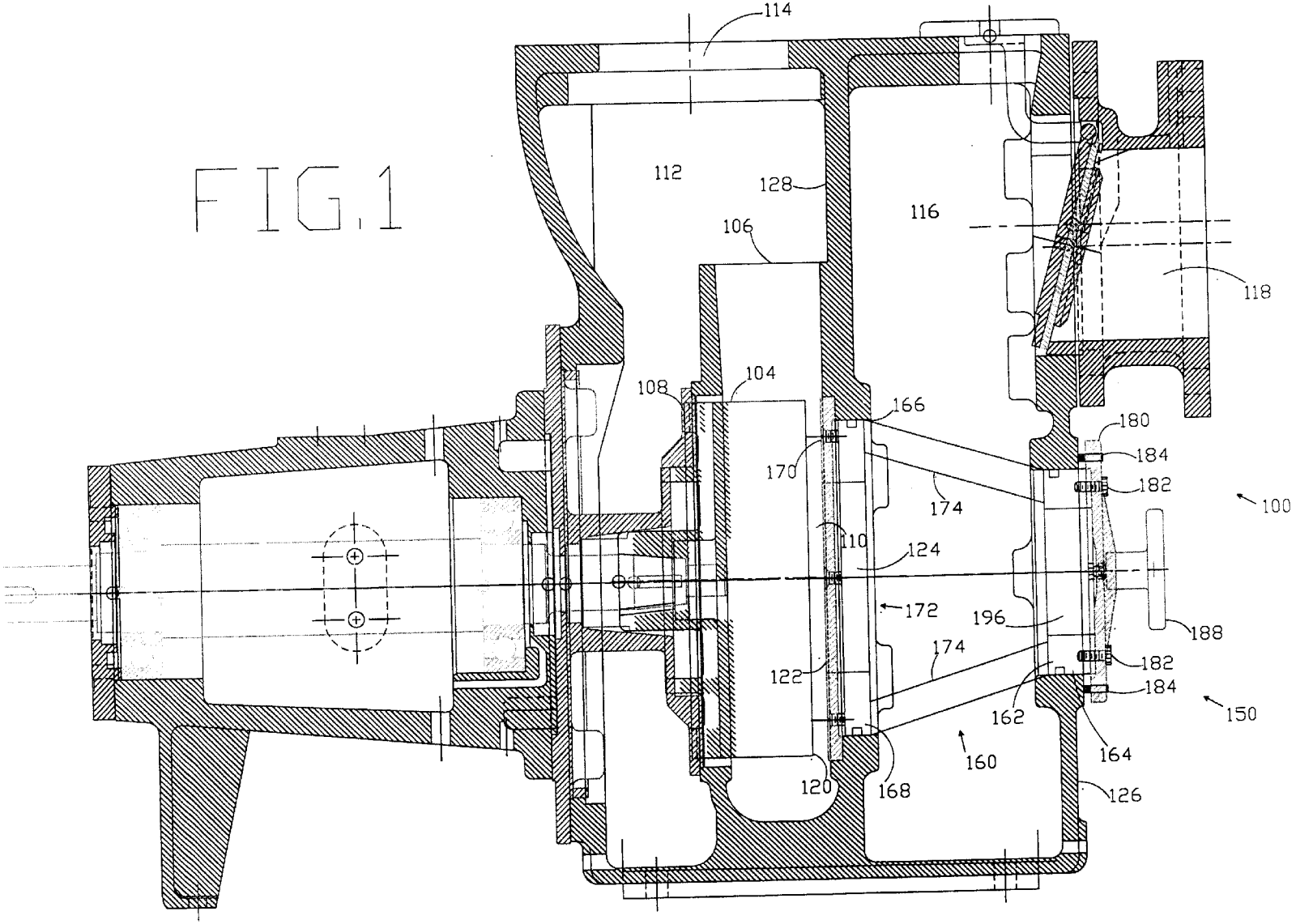
FIG. 1 is a sectional view through a pump having an adjustable wear plate positioning assembly according to the present invention.
Figure 2:
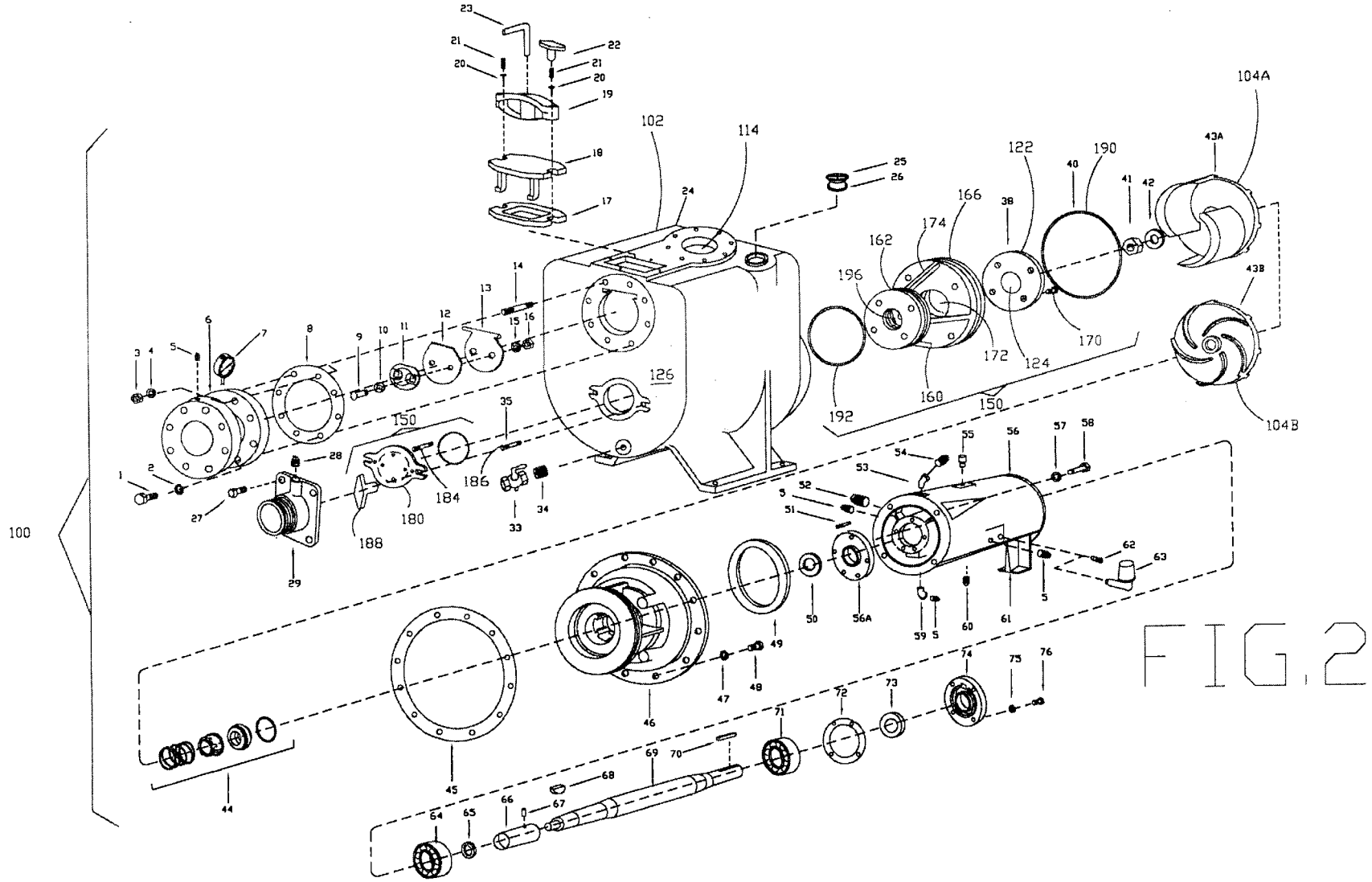
FIG. 2 is an exploded view of a typical pump incorporating an adjustable wear plate positioning assembly according to the present invention; and, FIG. 3 is an end elevation of the pump of FIGS. 1 and 2.
Figure 3:
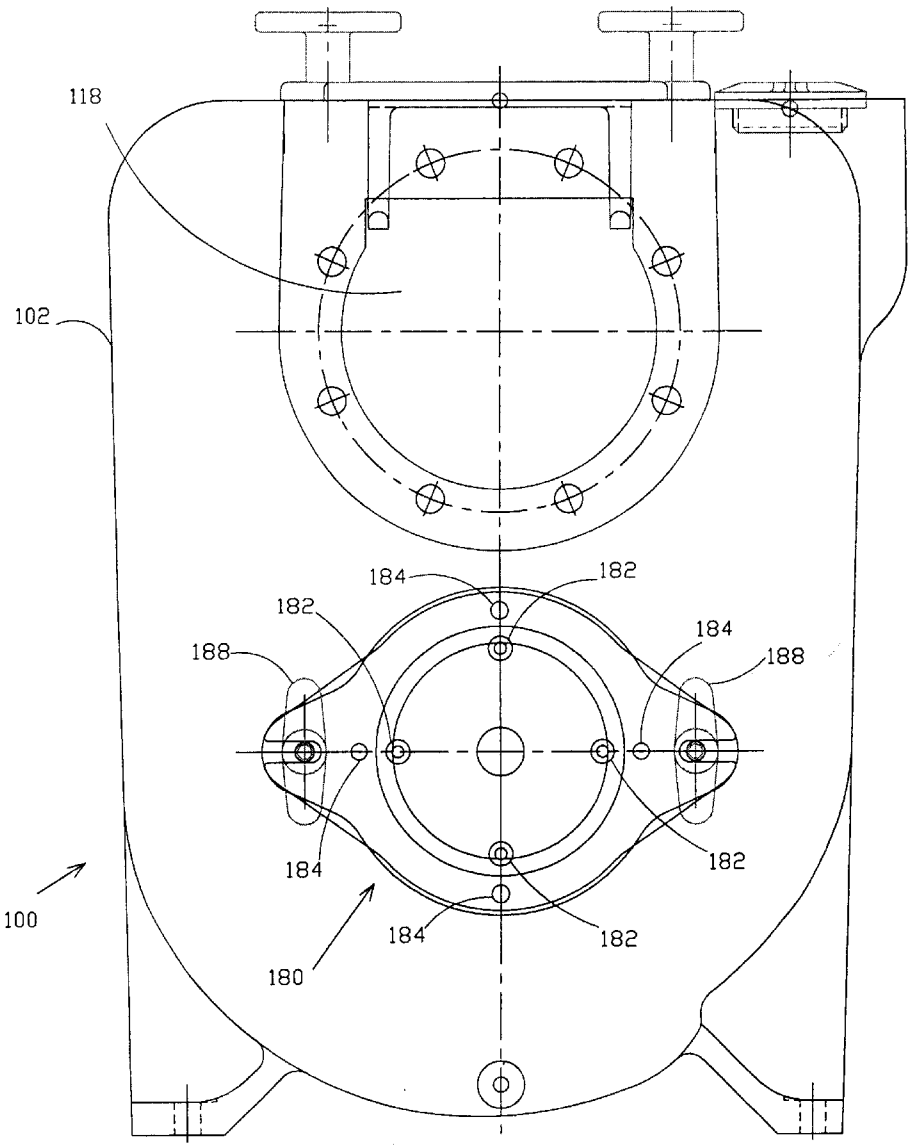

A pump is generally indicated by reference 100 in the accompanying drawings. The basic structure of the pump 100 is known and would be readily understood by one skilled in the art. Accordingly for the sake of completeness a parts list which may be referenced to FIG. 2 is provided at the end of the disclosure. The overall structure and operation of the pump is not described in detail other than those components relevant to the understanding and practice of the present invention.

The pump 100 has a casing 102 which houses an impeller such as illustrated by reference 104A or 104B. The impeller configuration will be selected depending on the pump application. The 104A variant is a double vane chopper for handling particularly large particles within the fluid passing through the pump. The impeller 104B has more vanes and would provide greater pumping efficiency, albeit with less ability to handle large solids passing through the pump. These are but two of many possible configurations.

The casing 102 defines a circumferential face 106 and a rear face 108 of an impeller chamber 110 disposed about the impeller. The housing may be in more than one part. For example the rear face 108 of the impeller chamber may be releasably secured to the balance of the casing 102. A discharge chamber 112 fluidly communicates with the impeller chamber 110 and has a discharge outlet 114 for discharging fluid from the casing 102.

An inlet chamber 116 fluidly communicates with the impeller chamber 110 and has an inlet port 118 through the casing 102 which provides a fluid passage to an inlet face 120 of the impeller 104.

The impeller chamber 110 is further defined by a wear plate 122 adjacent the inlet face 120 of the impeller 104 and has a fluid passage 124 therethrough for admitting fluid axially into the impeller chamber 110.

The casing 102 has a front wall 126 opposite the inlet face 120 of the impeller 104 and a partition wall 128 dividing the inlet chamber 116 from the outlet chamber 112.

An adjustable wear plate positioning assembly is generally indicated by reference 150 in the accompanying illustrations. The assembly 150 has a wear plate carrier 160 extending between the front wall 126 and the partition wall 128. The wear plate carrier 160 has an annular outer end 162 slidably received in a first aperture 164 extending through the front wall 126 opposite the inlet face 120 of the impeller 104. The first aperture 164 is remote from the inlet port 118.

The wear plate carrier 160 further has an inner end 166 which is also annular and which is slidably received within a second aperture 168 through the partition wall 128 adjacent the inlet face 120 of the impeller 104.

The wear plate 122 is rigidly secured to the inner end 166 of the wear plate carrier 160 for example by machine screws 170. In this manner the wear plate 122 may be replaced should this become necessary. The inner end of the wear plate carrier 160 has a passage 172 therethrough registering with the fluid passage 124 through the wear plate. This allows fluid to pass from the inlet chamber 116 into the impeller housing 110. A plurality of struts 174 extend between the inner end 166 and the outer end 164 of the wear plate carrier 160 to maintain the inner end 162 and the outer end 166 in a spaced apart arrangement. Spaces between the struts 174 allow fluid access to the passage 172 through the wear plate carrier and hence into the impeller chamber 110. Preferably the struts 174 and their layout should be configured so as not to impede fluid (effluent) flow to the impeller 104.

A mounting plate 180 is disposed externally of the casing 102 adjacent the front wall 126 and secured to the outer end 162 of the wear plate carrier 160 by suitable fasteners such as bolts 182.

Adjustable limit means such as set screws 184 threadedly engage the mounting plate 180 and extend between the mounting plate 180 and the front wall 126 of the casing 102 to limit movement of the mounting plate 180 and in turn the wear plate 122 toward the impeller 104.

Releasable locking means such as studs 186 secured to the casing 102 and nuts 188 for engaging the studs 186 and the mounting plate 180 act as releasable locking means between the front wall 126 and the mounting plate 180 for securing the mounting plate 180 in position relative to the front wall 126.

In order to adjust the position of the wear plate 122, the nuts 188 are released in order to take pressure off of the set screws 184. The set screws 184 may then be backed off using an allen key or other suitable tool to allow the mounting plate 180 to be urged towards the front wall 126 of the casing 102. This in turn causes the wear plate carrier 160 and the wear plate 122 secured thereto to move toward the front face 120 of the impeller 104 until the wear plate 122 abuts against the front face 120 of the impeller 104. Using this as a reference the set screws 184 are tightened by equal amounts (to maintain alignment) while monitoring the amount of movement of the mounting plate 180 away from the front wall 126. When an amount of movement is observed which corresponds to a desired clearance between the wear plate 122 and the inlet face 120 of the impeller 104 further tightening the set screws 184 is ceased. At this point the nuts 188 are tightened in order to secure the mounting plate and in turn the wear plate carrier 160 and the wear plate 122 in position.

Various means may be used to monitor the amount of movement of the mounting plate 180 away from the front wall 126. For example a dial indicator may be used. Alternatively, if the thread pitch of the set screws 184 is known, the set screws 184 may be rotated by an amount corresponding to the desired movement of the mounting plate 180.

The above adjustable limit means and releasable locking means are but one way of carrying out the present invention. They are desirable as being simple, inexpensive and adaptable to existing pumps without significant modification. No doubt other means will be apparent to a person skilled in such apparatus will stay within the scope of the present invention. For example cam means might be provided in lieu of the set screws 184. Alternatively the mounting plate 180 might threadedly engage the front wall 126.

In order to avoid leakage between the inner end 166 of the wear plate carrier 160 and the partition wall 128, a suitable fluid sealing member such as O-ring 190 may be provided about the periphery of the inner end 166. In order to provide a fluid seal between the outer end 162 and the front wall 126, a further suitable sealing means such as O-ring 192 may be provided about the periphery of the first end 162. The O-ring 190 acts between the inner end 166 and the second aperture 168. The O-ring 192 acts between the outer end 162 and the first aperture 164.

It is desirable to provide access to the impeller 104 and the impeller chamber 110 through the front wall 126 in order to allow debris to be cleaned out of the impeller housing 110. One manner of doing so is to provide a passage 196 through the outer end 162 and to use the mounting plate 180 as a removable cover over the aperture which, when removed, provides access through the passage 196 and the passage 172 in the inner end of the impeller housing 110.

The above is intended in an illustrative rather than a restrictive sense. Variations to the exact embodiment described may be apparent to those skilled in such structures without departing from the spirit and scope of the invention as defined by the claims set out below.

Parts List

| Number | Description |
|---|---|
| 1 | Bolt, Inlet Flange |
| 2 | Lock Washer, Inlet Flange |
| 3 | Nut, Inlet Flange |
| 4 | Lock Washer, Inlet Flange |
| 5 | Plug |
| 6 | Suction Flange |
| 7 | Pressure Gauge |
| 8 | Gasket, Suction Inlet |
| 9 | Bolt, Check Valve |
| 10 | Washer, Check Valve |
| 11 | Lower Weight Valve |
| 12 | Check Valve Facing Gasket |
| 13 | Upper Weight, Hinged |
| 14 | Stud, Suction Inlet |
| 15 | Lock Washer, Check Valve |
| 16 | Nut, Check Valve |
| 17 | Gasket, Top Check Valve Cover |
| 18 | Cover, Top Check Valve Cover |
| 19 | Yoke |
| 20 | Washer, Top Check Valve Cover |
| 21 | Stud, Top Check Valve Cover |
| 22 | Hand Knob, Top Check Valve Cover |
| 23 | L-Handle, Top Check Valve Cover |
| 25 | Filler Plug |
| 26 | Gasket, Filler Plug |
| 27 | Bolt |
| 28 | Plug |
| 29 | Suction Inlet, Straight In Suction |
| 31 | Clean Out Cover |
| 32 | Gasket, Clean Out Cover |
| 33 | Ball Valve |
| 34 | Nipple |
| 41 | Lock Nut, Impeller |
| 42 | Dished Washer, Impeller |
| 44 | Mechanical Seal |
| 45 | Gasket, Stuffing Box |
| 46 | Stuffing Box |
| 47 | Lock Washer, Stuffing Box |
| 48 | Bolt, Stuffing Box |
| 49 | Gasket, Bearing House |
| 50 | Oil Seal, Bearing House |
| 51 | Stud, Bearing House |
| 52 | Plug, Bearing House |
| 53 | Elbow, Bearing House |
| 54 | Plug, Bearing House |
| 55 | Filter Vent |
| 56 | Bearing Housing |
| 57 | Lock Washer, Bearing Housing |
| 58 | Bolt, Bearing Housing |
| 59 | Elbow, Bearing Housing |
| 60 | Plug, Bearing Housing |
| 61 | Foot Mount, Bearing Housing |
| 62 | Sight Glass, Bearing Housing |
| 63 | Oiler |
| 64 | Radial Control Load Bearing |
| 65 | Gasket, Shaft Sleeve |
| 66 | Stainless Steel Shaft Sleeve |
| 67 | Roll Pin |
| 68 | Impeller Key |
| 69 | Shaft |
| 70 | Key, Shaft Drive End |
| 71 | Axle Control Bearing |
| 72 | Bearing Cover Gasket |
| 73 | Oil Seal, Bearing House |
| 74 | Bearing Cover |
| 75 | Lock Washer, Bearing Cover |
| 76 | Bolt, Bearing Cover |
| 100 | Pump |
| 102 | Casing |
| 104 | Impeller |
| 106 | Circumferential Face |

-continued

Parts List

| Number | Description |
|---|---|
| 108 | Rear Face |
| 110 | Impeller Chamber |
| 112 | Discharge Chamber |
| 120 | Inlet Face |
| 122 | Wear Plate |
| 124 | Fluid Passage |
| 126 | Front Wall |
| 128 | Partition Wall |
| 150 | Adjustable Wear Plate Positioning Assembly |
| 160 | Wear Plate Carrier |
| 162 | Outer End (Wear Plate Carrier) |
| 164 | First Aperture |
| 166 | Inner End (Wear Plate Carrier) |
| 168 | Second Aperture |
| 172 | Passage (Wear Plate Carrier) |
| 174 | Spaced Apart Struts |
| 180 | Mounting Plate |
| 184 | Adjustable Limit Means |
| 186 | Locking Means (Studs) |
| 188 | Locking Means (bolts) |
| 196 | Aperture (Outer End) |

What is claimed is:

1. An adjustable wear plate positioning assembly (150) for a pump (100) having a casing (102) housing an impeller (104) and defining a circumferential (106) and a rear face (108) of an impeller chamber (110) disposed about said impeller (104), a discharge chamber (112) fluidly communicating with said impeller chamber (110) and having a discharge outlet (114) for discharging fluid from said casing, (102), an inlet chamber (116) fluidly communicating with said impeller chamber (110) having an inlet port (118) through said casing (102) and providing a fluid passage to an inlet face 120 of said impeller (104), said impeller chamber (110) being further defined by a wear plate (122) adjacent said inlet face (120) of said impeller (104) and having an fluid passage (124) therethrough for admitting fluid axially into said impeller chamber (110), said casing (102) having a front wall (126) opposite said inlet face (120) of said impeller (104) and a partition wall (128) dividing said inlet chamber (116) from said discharge chamber (112), said adjustable wear plate positioning assembly (150) comprising:

a wear plate carrier (160) extending between said front wall (126) and said partition wall (128) and having an outer end (162) slidably received in a first aperture (164) through said front wall (126) remote from said inlet port (118) and opposite said inlet face (120) of said impeller (104) and an inner end (166) opposite said outer end slidably received in a second aperture (168) through said partition wall (128) adjacent said inlet face (120) of said impeller (104);

said wear plate (122) being rigidly securable to said inner end (166) of said wear plate carrier (160) and said wear plate carrier (160) having a passage (172) extending through said inner end and registering with said fluid passage (124) through said wear plate for providing fluid communication between said inlet chamber (116) and said impeller chamber (110);

a mounting plate, disposed externally of said casing (102) adjacent said front wall (126) and secured to said outer end (162) of said wear plate carrier (160);

adjustable limit means (184) extending between said mounting plate (180) and said front wall (126) to limit movement of said mounting plate (180) and in turn said wear plate (122) toward said impeller (104); and releasable locking means (186, 188) acting between said front wall, (126) and said mounting plate (180) for securing said mounting plate (180) in position relative to said front wall (126).

2. The adjustable wear plate positioning assembly (150) of claim 1 wherein:

said adjustable limit means (184) includes a plurality of set screws (184) extending through said mounting plate (180) and abutting against said front wall (126).

3. The adjustable wear plate positioning assembly (150) of claim 1 wherein:

said releasable locking means (186, 188) includes a plurality of threaded fasteners (186) extending between said front wall (126) and said mounting plate (180).

4. The adjustable wear plate positioning assembly of claim 2 wherein:

said releasable locking means (186, 188) includes a plurality of threaded fasteners (186) extending between said front wall (126) and said mounting plate (180).

5. The adjustable wear plate positioning assembly (150) of claims 1, 2, 3, or 4 wherein:

said wear plate carrier (160) has a plurality of spaced apart struts (174) extending between said inner (166) and outer (162) ends;

said inner (166) and outer (162) ends are generally annular;

and respective fluid sealing members (190, 192) extend between said inner (166) and outer (162) ends of said second (168) and first (164) apertures.

6. The adjustable wear plate positioning apparatus (150) of claim 5 wherein:

said outer end (162) of said wear plate carrier (160) has a passage (196) extending axially therethrough and a removable cover (180) over said aperture (196) to provide access to aid impeller (104).

7. The adjustable wear plate positioning assembly (150) of claim 6 wherein:

said mounting plate (180) is removably secured to said outer end (162) and acts as said cover (180).

* * * * *